US008640317B2

(12) United States Patent
Scardovi et al.

(10) Patent No.: US 8,640,317 B2
(45) Date of Patent: Feb. 4, 2014

(54) UNIT FOR SUPPORTING CERAMIC PRODUCTS

(75) Inventors: Stefano Scardovi, Anita di Argenta (IT); Santo Monteforte, Faenza (IT)

(73) Assignee: Sacmi Cooperativa Meccanici Imola Societa' Cooperativa, Imola (IT)

( * ) Notice: Subject to any disclaimer, the term of this patent is extended or adjusted under 35 U.S.C. 154(b) by 129 days.

(21) Appl. No.: 13/201,407

(22) PCT Filed: Feb. 5, 2010

(86) PCT No.: PCT/IB2010/050529

§ 371 (c)(1),
(2), (4) Date: Aug. 12, 2011

(87) PCT Pub. No.: WO2010/097723

PCT Pub. Date: Sep. 2, 2010

(65) Prior Publication Data

US 2011/0297813 A1 Dec. 8, 2011

(30) Foreign Application Priority Data

Feb. 27, 2009 (IT) ..... BO09A0117

(51) Int. Cl.

| | |
|---|---|
| ***B25B 27/14*** | (2006.01) |
| ***B25B 1/06*** | (2006.01) |
| ***A61J 19/00*** | (2006.01) |

(52) U.S. Cl.
USPC ..... 29/281.1; 4/281.1; 269/254 CS

(58) Field of Classification Search
USPC ..... 269/254 CS, 17, 281.1, 281.3, 281.5, 269/271, 71, 37; 29/281.1; 4/252.1, 252.2, 4/252.3, 252.4
See application file for complete search history.

(56) References Cited

U.S. PATENT DOCUMENTS 5,645,863 A * 7/1997 Cuman et al. ..... 425/84

FOREIGN PATENT DOCUMENTS

| | | | |
|---|---|---|---|
| DE | 539 825 | C | 12/1931 |
| DE | 103 39 834 | A1 | 4/2005 |
| GB | 2 387 169 | A | 10/2003 |

* cited by examiner

*Primary Examiner* — Lee D Wilson
*Assistant Examiner* — Nirvana Deonauth
(74) *Attorney, Agent, or Firm* — Pearne & Gordon LLP

(57) ABSTRACT

Described is a unit for supporting ceramic products (1), in particular ceramic products (1) made by slip casting in porous molds; the unit (100) comprises a first element (2) for gripping and supporting the product (1); a second element (3) for supporting a first, base portion (Ia) of the product (1) and designed to at least partly support the weight of the product (1); and elements (4), positioned and acting on the second element (3), for elastically reacting along a vertical axis (Z).

15 Claims, 6 Drawing Sheets

UNIT FOR SUPPORTING CERAMIC PRODUCTS

TECHNICAL FIELD

This invention relates to a unit for supporting ceramic products, in particular ceramic sanitaryware.

BACKGROUND ART

As is well known, ceramic sanitaryware (such as toilet bowls, bidets, washbasins, console sinks, hand basins, wash tubs, shower trays, flush tanks and the like) is made by casting a fluid mixture (known as "slip" in the jargon of the trade, consisting of a ceramic body in aqueous suspension) in customary moulds with a porous structure, which may be divided into two or more parts.

The mould gives the article of sanitaryware the required shape and after a certain length of time (necessary to draw out a part of the water) the article is extracted from the mould in a solid form, known as "greenware" (still having a water content of between 16% and 20% by weight) and hence still subject to plastic deformation.

Contact of the sanitaryware article with the air (step of pre-drying the "greenware") brings about two main changes in the article, the first bringing it to an intermediate "leather-hard" state (in which the initial water content is reduced by 30% to 50%) and the second, to an almost finished "white-hard" state (in which the water content is practically zero): in these two states, the sanitaryware article is no longer subject to high levels of plastic deformation.

In one or more of these three different states, the sanitaryware article usually undergoes a plurality of finishing processes such as, for example, fettling, drilling of holes, slotting, radiusing and so on.

Thus, once the ceramic products have been demoulded, that is to say, removed from the mould, whether they have been cast in porous resin moulds (at high pressure) or in gypsum moulds (at low pressure), they must be held in a secure, stable position to enable the subsequent steps in the manufacturing process, including both drying and finishing, to be completed.

The supporting systems currently used are structured in a, so to speak, "rigid" manner, that is to say, they do not adapt to the linear and weight variations of the products (causing movements with horizontal and vertical components) as the products change from one state to another, in particular from the "green" to the "leatherhard" state.

Indeed, as the product dries, its diminishing water content results in weight loss and significant shrinkage of between 2% and 4% of its original size.

Current state-of-the-art stands and auxiliary structures supporting the base and, for example, the sides of a product are basically static supports and, as such, are unable to satisfactorily adapt to the settling that the product undergoes.

That means the state of the product must be closely monitored and the supporting structure adjusted according to the changes in the product: all of this is left to, and depends on, the experience of personnel responsible for that particular stage in the manufacturing process.

Obviously, if the supporting structure is not adjusted or, when necessary, parts of it substituted, the resulting tensional and/or deformation stresses can lead to irreparable defects or even breakage of the product.

A typical example of these problems is that of a fixture known in the trade as a "one-piece" toilet, namely, a toilet bowl (that is, a pan with added rim) made as a single part with a flush tank partially protruding from the back of the pan.

This type of sanitary fixture is too unstable to be handled after being demoulded: its centre of gravity does not permit the required balanced position without additional means (props) to support the sides and back of it during post-moulding operations such as fettling, for example.

This, as mentioned above, involves constant monitoring of the production process and repositioning of the props as the product changes from one state to another. These operations take time, may interrupt finishing processes and involve high scrap rates.

AIM OF THE INVENTION

This invention therefore has for an aim to overcome the above mentioned disadvantages by providing a unit for supporting ceramic products and which automatically adjusts to the dimensional changes of a product without deforming or breaking the product as it changes from one state to another.

Another aim of the invention is to provide a support structured in such a way as to allow correct and balanced ventilation of the product it supports, as well as handling and fettling.

Yet another aim of the invention is to provide a versatile support unit which besides supporting ceramic products of different kinds, can be used both in high-pressure high-productivity casting plants and in low-pressure, standard-productivity casting plants.

According to the invention, these aims are achieved by a support unit, in particular a support unit comprising the technical characteristics set out in one or more of the appended claims.

BRIEF DESCRIPTION OF THE DRAWINGS

The technical characteristics of the invention, with reference to the above aims, are clearly described in the appended claims and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
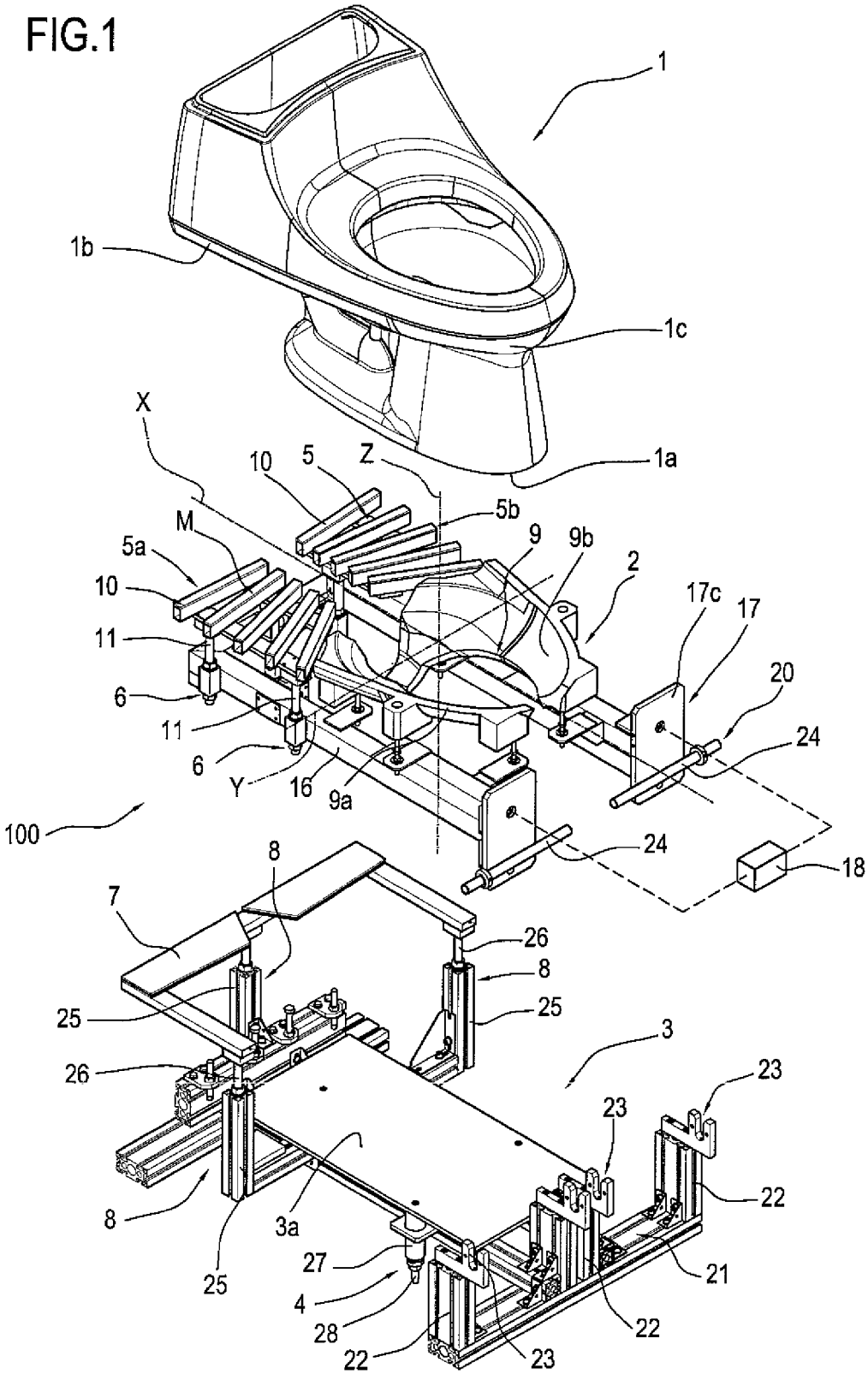
FIG. 1 is a perspective exploded view, with some parts cut away to better illustrate others, of a unit for supporting ceramic products according to the invention.

With reference to the accompanying drawings, in particular FIG. 1, the unit according to the invention, labelled 100 in its entirety, is used for supporting ceramic products 1, in particular ceramic products 1 made by slip casting in moulds, for example, of the porous type.

The unit 100 must support the product 1 at least from the step of removing it from the mould (not illustrated) to the end of the step of drying it in air (also referred to as drying to the "leatherhard" state) where the product passes from the "green" state to the "leatherhard" state, losing a considerable amount of its water content and undergoing dimensional shrinkage.

In particular, but without limiting the scope of the inventive concept, the support according to the invention can be used for ceramic sanitaryware and the example used in the embodiment illustrated here is known in the trade as a "one-piece" toilet, namely, a toilet bowl (that is, a pan with added rim) made as a single part with a flush tank partially protruding from the back of the pan.

Obviously, the invention disclosed can be used for sanitary fixtures of other kinds, such as toilet bowls without the flush tank, bidets, washbasins, console sinks, hand basins, wash tubs, shower trays, and the like) without thereby limiting the scope of the inventive concept.

Still with reference to FIG. 1, the support unit 100 comprises the following main components:

- a first element 2 for gripping and supporting the product 1;
- a second element 3 for supporting a first, base portion 1*a* of the product 1 (in the case illustrated, the base of the load) and designed to at least partly support the weight of the product 1;
- elements 4, positioned and acting on the second element 3, for elastically reacting along a vertical axis Z.

More specifically, in the non-limiting embodiment illustrated, the first element 2 is used to grip and move the product 1 from a casting station and to place it on the second element 3.

Obviously, in the example illustrated, the first element is physically separate from the second element 3.

In an equivalent embodiment, the two elements 2 and 3 may be made as a single part, without thereby limiting the scope of the invention.

In addition to the two elements 2 and 3 there is also a first supporting surface 5 on the first gripping and supporting element 2. The first surface 5 supports a second portion 1*b* of the product 1 (in this case, the base of the protruding flush tank).

The first supporting surface 5 is operated upon by elements 6 for adjusting the first supporting surface 5 itself at least along a first horizontal axis X.

More specifically, the elements 6 for adjusting the first supporting surface 5 may also act along a second horizontal axis Y and, preferably, as described in more detail below, the adjustment elements 6 can operate along two or more horizontal axes lying between the first and the second orthogonal horizontal axes X and Y.

Looking now at the second supporting element 3, this comprises a second supporting top 7, at a higher level, for supporting an end section of the second portion 1*b* of the product 1 supported by the first surface 5 of the first element 2. The second supporting top 7 may be equipped with means 8 for adjustment in height relative to a platform 3*a* for supporting the first portion 1*a* of the product in such a way that it can remain in substantially the same plane as the first surface 5.

Looking more closely at the technical details, the second element 3 comprises a load-bearing frame 21.

The frame 21 is equipped with:

- the platform 3*a* for supporting the first base portion 1*a* of the product 1; the platform 3*a* being provided with the elastic reaction elements 4, interposed between the platform 3*a* and a fixed, or treadable, surface P, and connected to the frame 21;
- a first plurality of vertical columns 22 equipped with cradles 23 for accommodating stable coupling pins 24 provided on the first element 2;
- a second plurality of vertical columns 25 which accommodate the adjustable means 8 for supporting a plate 7 lying in the same plane as the first supporting surface 5.

Figure 2:
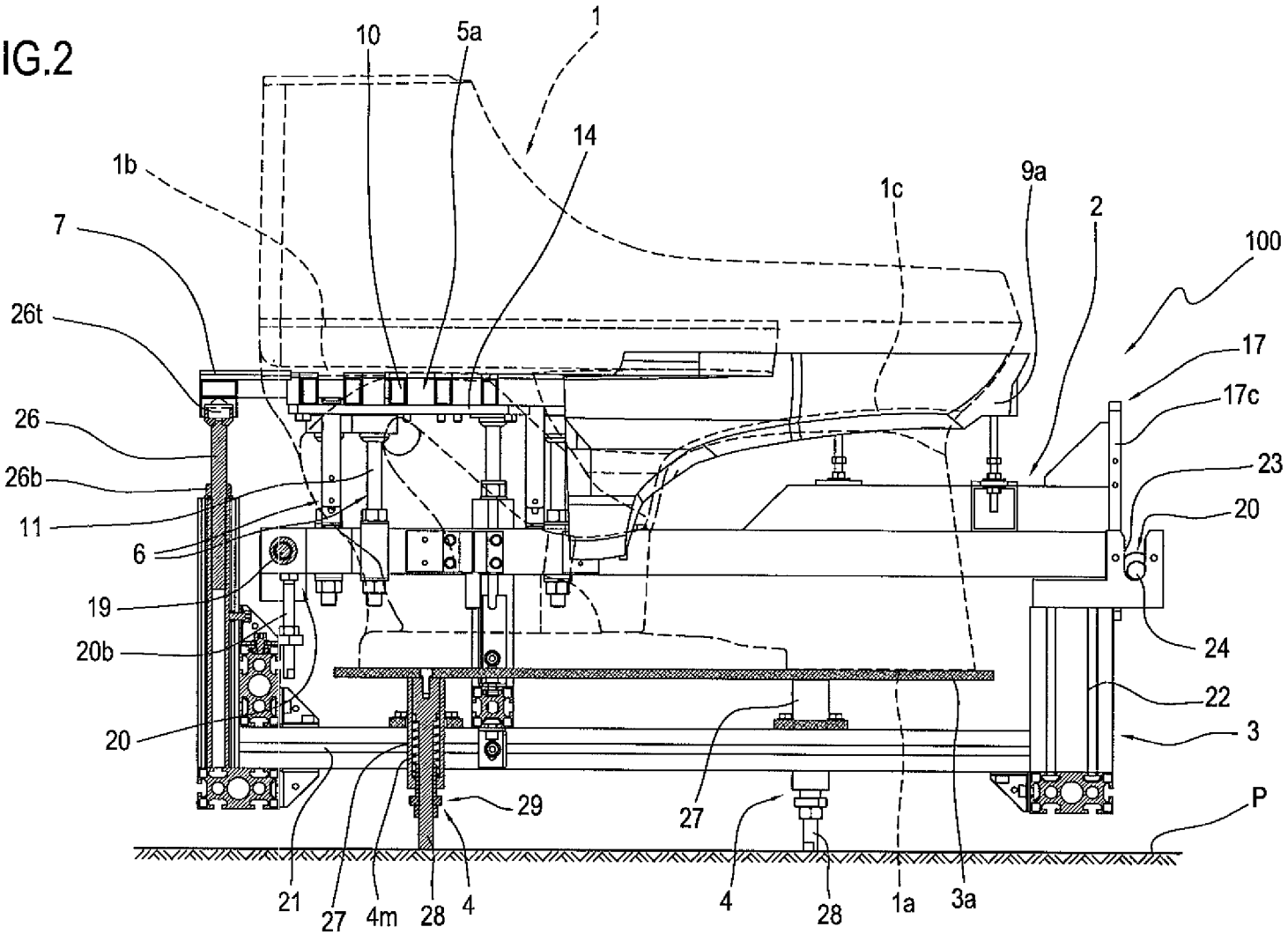
FIG. 2 is a side view, with some parts cut away and others in cross section, showing the support unit of FIG. 1, in an assembled state.

As illustrated in FIG. 2, each elastic reaction element 4 (in this particular non-limiting example there are three), may comprise a hollow tubular body 27 for housing a spring 4*m* and an opposing pin 28 inserted in the spring 4*m*.

At one end of it, each pin 28 is associated with the above mentioned platform 3*a* and, at the other end, is in contact with the fixed, or treadable, surface P.

Between each pin 28 and the tubular body 27 there are interposed adjustable means 29 for controlling the downward movement of the pin 28, thus compressing the spring 4*m* according to presettable parameters depending both on the type of product supported and on the initial weight of the product.

Thanks to this structure, each of the elastic reaction elements 4 can be set independently of the others.

Looking now at the vertical columns 25 of the second plurality, these are tubular in shape and hollow in order to house the adjustable means 8 that support the supporting plate 7 (constituting the above mentioned second supporting top) for the second surface 5.

Figure 5:
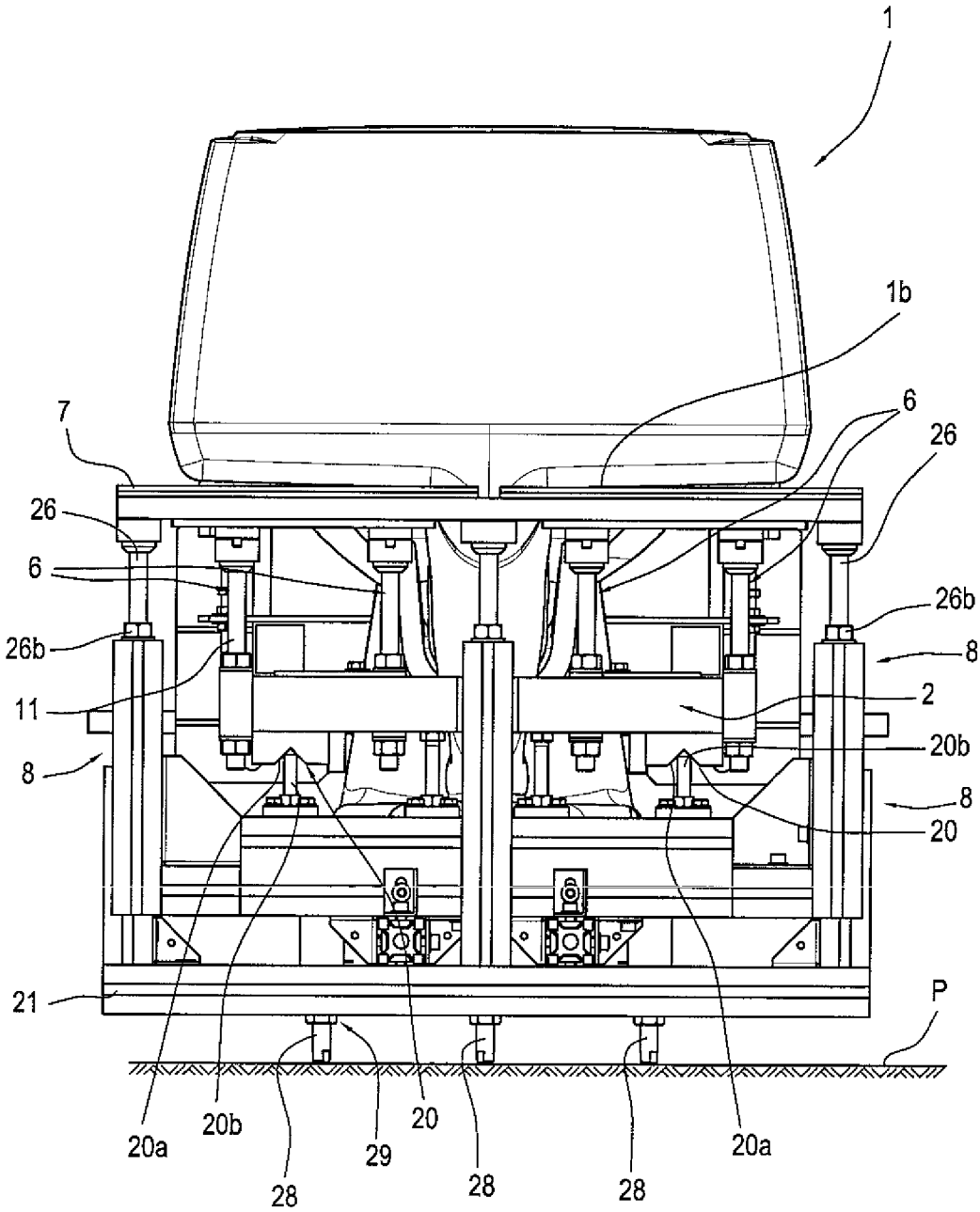
FIG. 5 is a rear view of the unit of FIG. 2.

The adjustable means 8 comprise respective cylinders 26 that slide in the columns 25 (see FIGS. 2 and 5) and can be locked in a required position using retaining bolts 26*b*.

Each cylinder 26 has a semi-spherical endpiece 26*t* supporting the top 7 (see FIG. 2).

Figure 3:
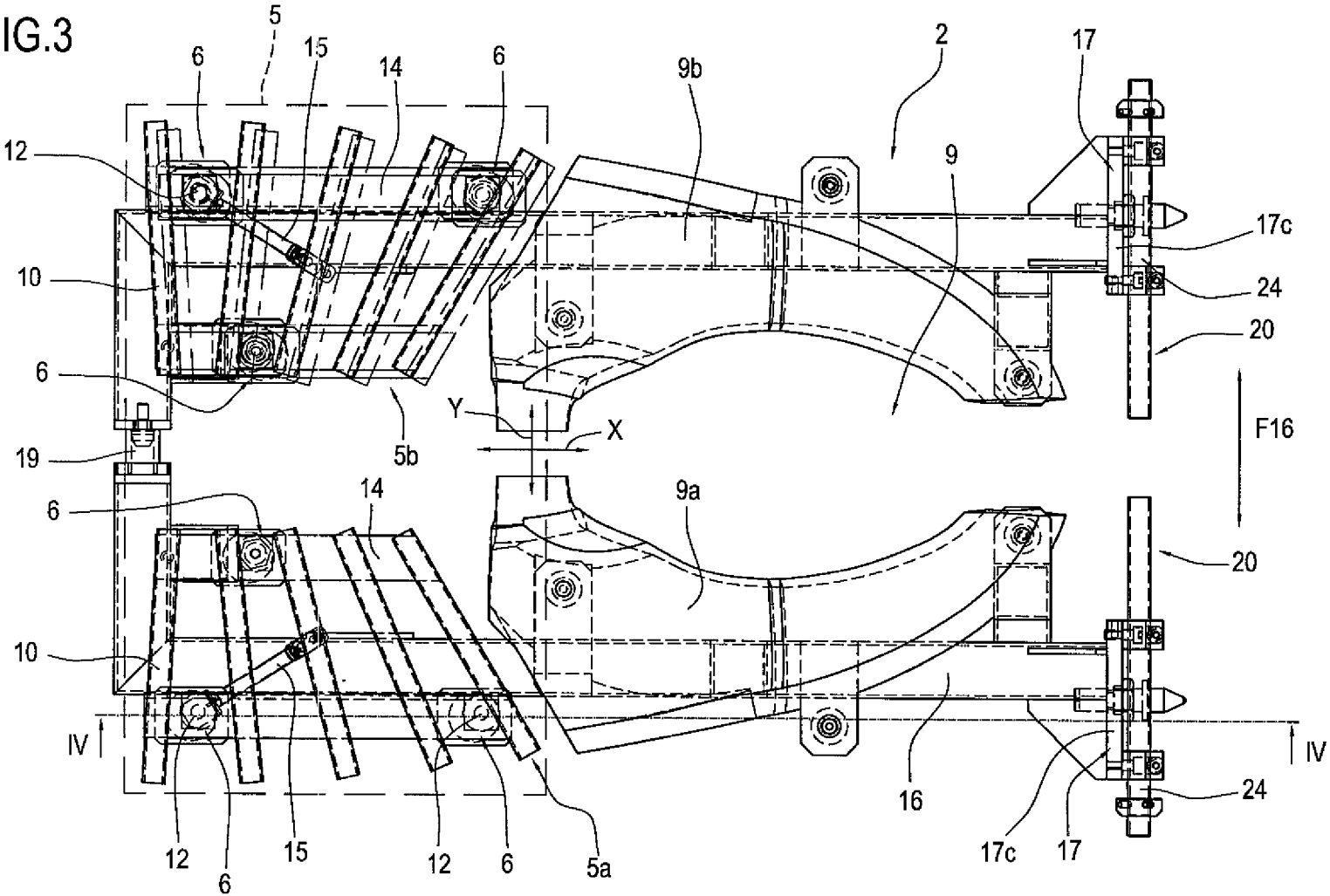
FIG. 3 is a plan view from above showing the unit illustrated in the figures listed above.
Figure 4:
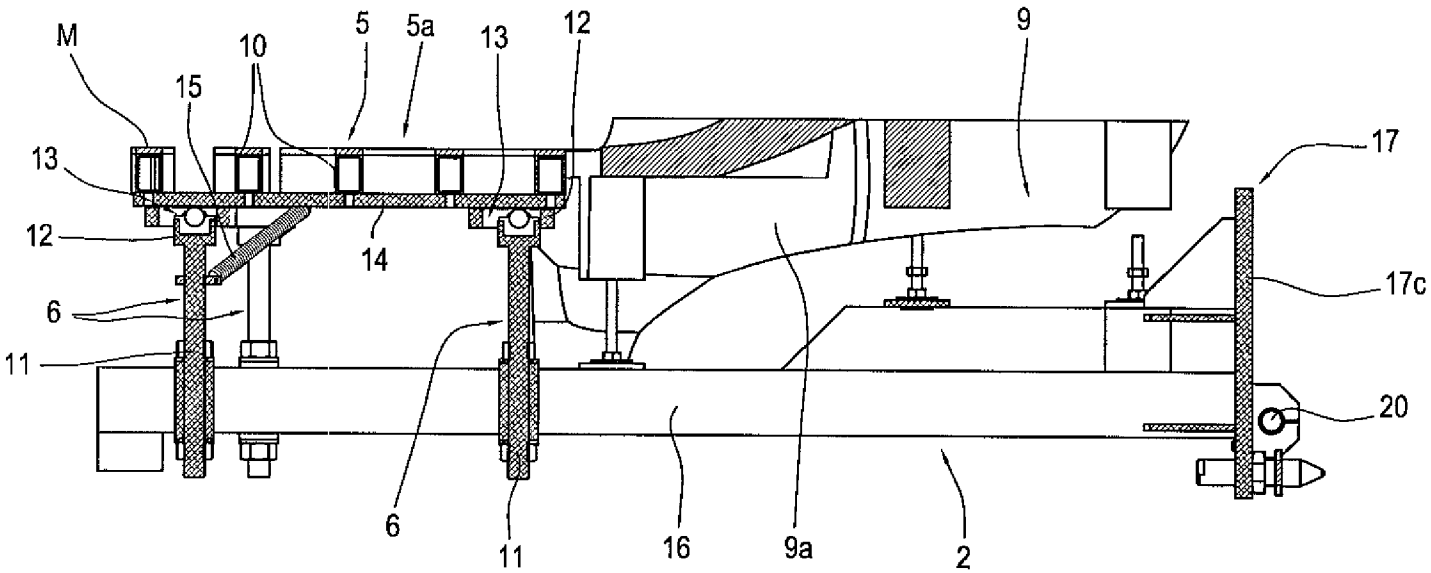
FIG. 4 is cross section through line IV-IV of FIG. 3.

As illustrated in FIGS. 1, 3 and 4, the first element 2 comprises a U- or fork-shaped base frame 16 which mounts:

- means 17 for coupling to a robot unit 18 (illustrated as a block in the drawings since it is of known type and does not strictly fall within the scope of the invention) for moving the first element 2, the means 17 being located at the open end of the U;
- a cylinder 19 for sliding and centering the arms of the fork 16 and mounted at the closed end of the latter in order to enable the two arms to be moved towards and away from each other under the action of the robot unit 18 (see arrow F16 in FIG. 3);
- means 20, located at the ends of it, for stable coupling to the second element 3;
- the first surface 5 for supporting the second portion 1*b* of the product 1;
- the elements 6, positioned between the frame 16 and the first surface 5, for adjusting the first supporting surface 5 along two or more horizontal axes lying between a first and a second orthogonal horizontal axis X and Y;
- a second supporting surface 9 shaped to match a third portion 1*c* of the product 1, which, in this case, is the front, convex outside portion of the toilet pan.

More in detail and starting from the first item in the list set out above, the means 17 for coupling to the robot unit 18 are embodied by vertical plates 17*c*, which are also equipped with the above mentioned coupling pins 24 in the cradles 23 of the load-bearing frame 21 of the second element 3.

At the back of the fork-shaped frame 16, on the other hand, there are seats 20*a* for coupling to respective vertical centering pins 20*b* located at the bottom of the frame 21 of the second element 3: in this way, the first element 2 is positioned precisely and held rigidly in the closed configuration during the steps of drying and finishing the product 1.

The first supporting surface 5 (see FIGS. 1 to 5 again) comprises two identical, symmetrical half parts 5*a*, 5*b*, each of which comprises a plurality of spaced crossbars 10 for coming into contact with the second portion 1*b* of the product 1.

Each crossbar 10 is preferably provided with elastically compliant, low-friction material M (rubber or sponge) for coming into contact with the product 1.

Each of the parts 5*a*, 5*b* is supported by a plurality of pins 11 (in this case, there are three per part) connected to the frame 16 and equipped, at the top end, with a respective contact ball bushing 12 housed in a socket 13 made on horizontal beams 14 that support the parts 5*a*, 5*b*.

As clearly shown in FIGS. 3 and 4, the perimetric dimensions of each socket 13 are greater than the diameter of the ball bushing 12, so as to allow limited movement of each part 5*a*, 5*b* along two or more horizontal axes lying between the aforementioned first and second orthogonal horizontal axes X and Y (see arrows X and Y and the dashed lines representing the half parts 5*a*, 5*b*).

Further, between one of the pins 11 of each part 5*a*, 5*b* (in this particular case, the one located close to the rear end of the frame 16) and a respective supporting beam 10, there is an interposed elastic member 15 designed to allow the respective part 5*a*, 5*b* to return to a predetermined position when the dried product 1 is moved away.

The above mentioned second supporting surface 9 that is shaped to match the third portion 1*c* of the product 1, has two rigid half-cradles 9*a*, 9*b* facing each other to form a bottom profile for coupling to the third portion 1*c* of the product 1.

As emerges clearly from the above description of the frame 16, the first and second surfaces 5 and 9 are divided into two half-parts in such a way as to enable the frame 16 to open and close like a fork during the positioning, gripping and transporting of the product to the drying zone where the second element 3 is located.

As mentioned above, the unit according to the invention may be embodied in several different ways according to constructional requirements and the type of product.

Figure 6:
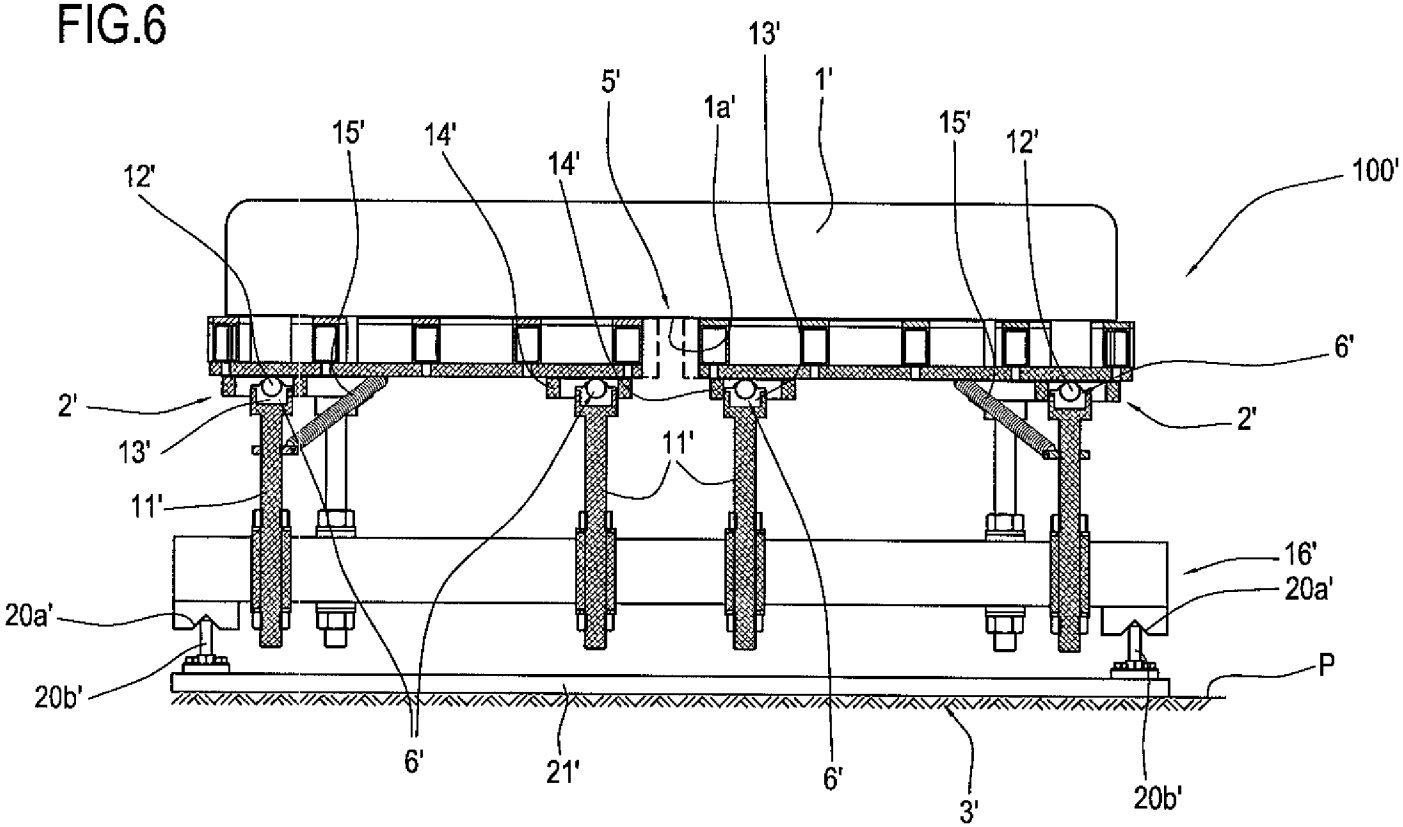
FIG. 6 shows another embodiment of the support unit according to the invention in a schematic side view, with some parts in cross section to better illustrate certain details.

FIG. 6, for example, shows another possible embodiment 100' structured to support a shower tray, where the first element 2' comprises half parts, similar to those described above, to obtain a supporting surface 5' which, in this case, supports a first (and, in this case, single) base portion 1*a'* of the product 1' to be dried.

This surface is equipped with elements 6' (similar to those described above), positioned between a frame 16' and the surface 5', for adjusting or compensating the surface 5' along two or more horizontal axes lying between a first and a second orthogonal horizontal axis X and Y: in this way, the shrinkage of the product 1 is "followed" by the surface 5'.

In other terms, the first element 2' is supported by a plurality of pins 11' connected to the frame 16' and equipped, at the top end, with a respective contact ball bushing 12' housed in a socket 13' made on horizontal beams 14' that support the different parts forming the surface 5'.

As clearly shown in FIG. 6, the perimetric dimensions of each socket 13' are greater than the diameter of the ball bushing 12', so as to allow limited movement of the part or parts of the surface 5' along two or more horizontal axes lying between the aforementioned first and second orthogonal horizontal axes X and Y.

In this case, too, the invention contemplates the provision, between one of the pins 11' and a respective supporting beam 10', of an interposed elastic member 15' designed to allow the respective part of the surface 5' to return to a predetermined position when the dried product 1' is moved away.

Further, at the front and back of the frame 16', the first element 2' may be equipped with two or more seats 20*a'* for coupling to respective vertical centering lock pins 20*b'* located at the bottom of the frame 21' of a second element 3': in this way, the first element 2' is positioned precisely and held rigidly in the stable configuration during the steps of drying and finishing the product 1'.

That does not mean that the first element 2' cannot be placed directly on the treadable surface P, in which case it would itself constitute the second supporting element.

A unit 100 embodied as above can be used in the manner described below by way of non-limiting example.

The robot unit 18 associated with the first element 2 moves the latter away from the forks of the frame 16 (see arrow F16) to receive the product 1 which is still at the casting station and from which the mould parts have been removed.

The robot unit 18 places the second element 2 in "collar-like fashion" round the product 1 and then moves the forks of the frame 16 closer together in such a way that the half-parts forming the first and second surfaces 5 and 9 move closer and into contact with the respective second and third portions 1*b* and 1*c* of the product 1.

The robot unit 18 then picks up the first element 2 and the product 1 and places them on the second element 3 precisely thanks to the pins that fit into the cradles and the seats coupled to the centering pins.

When the first element 2 is positioned, the first, base portion 1*a* of the product 1 is rested on the platform 3*a* and thus on the elastic reaction elements 4 which support the entire structure.

The springs 4*m*, being pre-loaded, give under the weight of the product 1 in such a way that positioning of the product 1 is also referenced to the plate 7, which supports an end portion of the flush tank, as well as to the position of the first element 2 on the second element 3.

At this point, the product 1 is stably positioned on the unit 100 and can dry in the green state, exposed to the air.

The loss of weight resulting from the considerable loss of water is compensated by the platform springs (which raise the product along the vertical axis Z) in such a way as to keep the product in the correct position, supported by the two upper surfaces of the first element.

In addition to the weight loss, the drying process leads to overall product shrinkage, which is compensated thanks to the freedom of movement both along the vertical axis Z, as mentioned above, and along the axes X and Y permitted by the movement of the first surface which adjusts to the shrinkage of the product.

Obviously, if the elements 2 and 3 form a single structure, all the parts of the product are positioned and fully supported as soon as it is picked up from the casting station.

The embodiment of FIG. 6 works in much the same way. Unlike the first embodiment, the product can be rested on the surface 5' of the first element 2', which can in turn be placed on the second element 3' or directly on a supporting, or treadable, surface P.

A support unit made as described above fully achieves the aforementioned aims thanks to the presence of two self-adjusting elements which interact with each other to provide the following advantages:

adjustment along the vertical axis automatically compensates for weight loss and shrinkage thanks to the pre-loaded springs and enables $\Delta Z$ to be controlled in such a way that the height of the product is always referenced to the upper surfaces, thus preventing product stress due to slipping;

adjustment along the horizontal axes allows the first surface to "follow" and adapt to the movements caused by product shrinkage without stressing the parts of the product as it dries;

the elastically deformable or compliant surfaces of the beams prevent deformation and, at the same time, avoid sticking before the product is dry;

adjustment in all three dimensions to adapt to the changes in the weight and size of the product is substantially "automatic" and does not have to be closely monitored by personnel;

the entire structure, especially the contact surfaces, is designed to permit uniform ventilation of all parts of the product in order to minimize the risks of non-uniformity at the end of the process;

the supporting structure also allows certain finishing operations to be carried out in the "green" state and also in the "leatherhard" state safely and while the product is held firmly in place.

The unit according to the invention thus positions and holds the product stably and securely and, compared to traditional solutions, speeds up the drying process.

Moreover, the solution according to the invention can be adapted to all kinds of casting processes, especially high-pressure casting, where casting is very rapid and supports must be such as to avoid the need for human intervention to monitor and adjust them according to the changes in the state of the cast product.

The invention described above is susceptible of industrial application and may be modified and adapted in several ways without thereby departing from the scope of the inventive concept. Moreover, all the details of the invention may be substituted by technically equivalent elements.

The invention claimed is:

1. A unit for supporting ceramic products (1) made by slip casting and having at least a first base portion (1*a*) and a second portion (1*b*), comprising:

a first element (2) for gripping and supporting the product (1) at the second portion (1*b*);

a second element (3) having a platform (3*a*) for supporting said first base portion (1*a*) of the product (1) and designed to support at least partially the weight of the product (1);

elastic reaction elements (4), positioned and acting on the second element (3), for elastically reacting along a vertical axis (Z), wherein said elastic reaction elements (4) are interposed between the platform (3*a*) and a fixed surface (P) and comprise pre-loaded springs (4*m*) which are configured to give under the weight of the product (1) and to raise the product (1) along the vertical axis (Z) in such a way as to keep the product (1) in the desired position, wherein the product (1) is supported by two upper surfaces (5) of the first element (2), whereby adjustment along the vertical axis (Z) is provided to automatically compensate for weight loss and shrinkage of the product (1), by means of the pre-loaded springs (4*m*), in such a way that the height of the product (1) is always referenced to the upper surfaces (5), thus preventing product stress due to slipping, wherein the second element (3) has a frame (21) equipped with a first plurality of vertical columns (22) equipped with cradles (23) for accommodating stable coupling pins (24) provided on the first element (2).

2. The unit according to claim 1, wherein the first gripping and supporting element (2) has the upper surfaces (5) for supporting a second portion (1*b*) of the product (1); elements (6) provided for adjusting the upper surfaces (5) at least along a first horizontal axis (X) and operating on the upper surfaces (5).

3. The unit according to claim 1, wherein the first gripping and supporting element (2) has the upper surfaces (5) for supporting a second portion (1*b*) of the product (1); elements (6) being provided for adjusting the upper surfaces (5) at least along a second horizontal axis (Y) and operating on the upper surfaces (5).

4. The unit according to claim 1, wherein the first gripping and supporting element (2) has the upper surfaces (5) for supporting a second portion (1*b*) of the product (1); elements (6), operating on the upper surfaces (5), being provided for adjusting the upper surfaces (5) along two or more horizontal axes lying between a first and a second orthogonal horizontal axis (X, Y).

5. The unit according to claim 1, wherein the second supporting element (3), or platform, comprises a supporting top (7) at a higher level, for supporting an end section of the second portion (1*b*) of the product (1) and lying in the same plane as the upper surfaces (5) of the first element (2); the second, supporting top (7) being equipped with means (8) for adjusting it in height relative to the platform (3).

6. The unit according to claim 4, wherein the first gripping element (2) comprises a second supporting surface (9) shaped to match a third portion (1*c*) of the product (1).

7. The unit according to claim 4, wherein the upper surfaces (5) comprise two identical, symmetrical half parts (5*a*, 5*b*), each of which comprises a plurality of spaced crossbars (10) for coming into contact with the second portion (1*b*) of the product (1); each crossbar (10) being provided with elastically compliant, low-friction material (M) for coming into contact with the product (1).

8. The unit according to claim 7, wherein each part (5*a*, 5*b*) of the upper surfaces (5) is supported by a plurality of pins (11) equipped, at the top end, with a respective contact ball bushing (12) housed in a socket (13) made on horizontal beams (14) that support the parts (5*a*, 5*b*); the size of each socket (13) being such as to allow limited movement of each part (5*a*, 5*b*) along two or more horizontal axes lying between a first and a second orthogonal horizontal axis (X, Y).

9. The unit according to claim 8, wherein between at least one of the pins (11) of each part (5*a*, 5*b*) and a respective spaced crossbar (10), there is an interposed elastic member (15) designed to allow the respective part (5*a*, 5*b*) to return to a predetermined position when the product (1) is moved away.

10. The unit according to claim 6, wherein the second surface (9) of the first element (2) has two rigid half-cradles (9*a*, 9*b*) facing each other to form a bottom profile for coupling to the third portion (1*c*) of the product (1).

11. The unit according to claim 1, wherein the first element (2) comprises a U-shaped base frame (16) which mounts:

means (17) for coupling to a robot unit (18) for moving the first element (2), the means (17) being located at the open end of the U;

a cylinder (19) for sliding and centering the arms of the U, mounted at the closed end of the latter in order to enable the two arms to be moved towards and away from each other under the action of the robot unit (18);

means (20), located at the end equipped with the coupling means (17), for stable coupling to the second element (3);

upper surfaces (5) for supporting the second portion (1*b*) of the product (1);

elements (6), positioned between the frame (16) and the first surface (5), for adjusting the upper surfaces (5)

along two or more horizontal axes lying between a first and a second orthogonal horizontal axis (X, Y);

a second supporting surface (9) shaped to match a third portion (1*c*) of the product (1).

12. The unit according to claim 1, wherein the second element (3) comprises a frame (21) which mounts:

the platform (3*a*) for supporting the first base portion (1*a*) of the product (1) and provided with the elastic reaction elements (4), interposed between the platform (3*a*) itself and a fixed surface (P), and connected to the frame (21);

a first plurality of vertical columns (22) equipped with cradles (23) for accommodating stable coupling pins (24) provided on the first element (2);

a second plurality of vertical columns (25) which accommodate adjustable means (8) for supporting a plate (7) for referencing and partly supporting a second portion (1*b*) of the product (1).

13. The unit according to claim 12, wherein each elastic reaction element (4) comprises at least one spring (4*m*) interposed between the platform (3*a*) and the fixed surface (P).

14. The unit according to claim 12, wherein each elastic reaction element (4) comprises a hollow tubular body (27) for housing a spring (4*m*) and an opposing pin (28) inserted in the spring (4*m*); the pin (28) being, at one end of it, associated with the platform (3*a*) and, at the other end, being in contact with the fixed surface (P).

15. The unit according to claim 14, wherein between the pin (28) and the tubular body (27) there are interposed adjustable means (29) for controlling the downward movement of the pin (28), thus compressing the spring (4*m*) according to presettable parameters.

* * * * *

UNITED STATES PATENT AND TRADEMARK OFFICE

CERTIFICATE OF CORRECTION

PATENT NO. : 8,640,317 B2
APPLICATION NO. : 13/201407
DATED : February 4, 2014
INVENTOR(S) : Stefano Scardovi et al.

It is certified that error appears in the above-identified patent and that said Letters Patent is hereby corrected as shown below:

In the Specification

After "scrap rates" at column 2 line 12, and before "AIM OF THE INVENTION" at column 2 line 14, please insert the two paragraphs attached hereto --Patent document US5645863 describes an apparatus for de-molding sanitary ware castings from porous molds. This apparatus comprises a carriage which includes an upper frame structure on which a form is mounted, said form is capable of matching, at least in part, the outward shape of the piece to be molded. The mold is connected to the upper frame by an intermediate means of variable geometry so as to allow a range of motion. A pneumatic means is included to retain the form in contact with the cast piece.

Patent document DE539825 describes a unit for making a ceramic sanitary ware; said unit comprises four elements aimed at supporting, in two surfaces, the ceramic sanitary ware. The first element is a platform base for supporting a base portion of the product. The second element comprises a base platform to support a third element. The third element, interposed through first and second element, can move freely, with its upper end, with a swinging movement. The third element comprises a central body having triangular shaped section and two arms. These arms are disposed at opposite sides with respect to the central body and in contact with a surface of the ceramic stationary ware. These arms are configured for swinging along a vertical axis. The fourth element is an arm having an upper end in contact with a second surface of the ceramic product. This arm is swinging along a horizontal path and a vertical path.--

Signed and Sealed this
Second Day of June, 2015

Michelle K. Lee

Michelle K. Lee
*Director of the United States Patent and Trademark Office*